US008882527B1

(12) United States Patent
Chiang

(10) Patent No.: US 8,882,527 B1
(45) Date of Patent: Nov. 11, 2014

(54) CABLE CONNECTOR

(71) Applicant: Cheng Uei Precision Industry Co., Ltd., New Taipei (TW)

(72) Inventor: Chih Hsien Chiang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 24 days.

(21) Appl. No.: 13/874,074

(22) Filed: Apr. 30, 2013

(51) Int. Cl.
*H01R 13/627* (2006.01)
*H01R 13/641* (2006.01)

(52) U.S. Cl.
CPC ..... *H01R 13/6272* (2013.01); *H01R 13/641* (2013.01)
USPC ..... 439/354

(58) Field of Classification Search
USPC ..... 439/370, 374, 352, 354, 357
See application file for complete search history.

(56) References Cited

U.S. PATENT DOCUMENTS 5,330,366 A * 7/1994 Tsuji et al. ..... 439/352
6,361,347 B1 * 3/2002 Murakami et al. ..... 439/352
6,461,178 B1 * 10/2002 Fu ..... 439/224
2005/0106924 A1 * 5/2005 Roese ..... 439/352
2005/0159039 A1 * 7/2005 Matsunaga ..... 439/352
2008/0057769 A1 * 3/2008 Mase et al. ..... 439/352
2008/0153343 A1 * 6/2008 Kobayashi et al. ..... 439/374
2009/0111310 A1 * 4/2009 Burke et al. ..... 439/352

* cited by examiner

*Primary Examiner* — Neil Abrams
*Assistant Examiner* — Travis Chambers
(74) *Attorney, Agent, or Firm* — WPAT, P.C.; Anthony King

(57) ABSTRACT

Disclosed is a cable connector comprising a male connector and a female connector, wherein the male connector includes a male base and a plurality of male terminals received in the male base, a rear end of the male base defining a resilient arm protruded beyond the back of the male base, a substantial middle of a top of the resilient arm protruding upward to form a locking block, a guiding ramp being formed at a rear end of the locking block and slantwise connecting the back and a top face of the locking block; a female connector includes a female base and a plurality of female terminals, a front face of the female base being concaved rearward to form a receiving chamber. The design is ensure that the male connector with the parent is not easy to quit after the engagement of the connector to avoid functional failure.

3 Claims, 5 Drawing Sheets

CABLE CONNECTOR

BACKGROUND OF THE INVENTION

1. Field of the Invention

The present invention relates to a connector, and more particularly to a cable connector.

2. The Related Art

Currently, many electronic products are provided with a complex circuit board which often has a plurality of pins thereon. Signal transmission between two circuit boards is realized generally via a cable connecting between corresponding pins.

In order to facilitate the assembly or separation of the two circuit boards, a cable connector has came with the tide of fashion. Currently, a conventional cable connector includes a male connector and a female connector often engaged with the male connector. The male connector includes a male base and a plurality of male terminals disposed in the male base with one end thereof being connected with a male circuit board via a cable. The female connector includes a female base and a plurality of female terminals disposed in the female base with one end thereof being directly soldered with a female circuit board. When the male connector is engaged with the female connector, the other ends of the male terminals and the female terminals electrically contact with each other to realized the signal transmission between the male circuit board and the female circuit board.

Generally, in order to ensure a steady signal transmission between the male circuit board and the female circuit board, the male connector and the female connector are often engaged with each other by means of plastic mutual interference of insulating housings thereof. However, the mutual interference performance is apt to weaken with repeatedly engaging and separating the male connector and the female connector that makes the male connector and the female connector easily disconnect with each other and results in the unexpected interruption of the signal transmission in the long time use. So a cable connector capable of overcoming the foregoing problems is required.

SUMMARY OF THE INVENTION

Accordingly, an object of the present invention is to provide a cable connector. A cable connector comprising a male connector and a female connector, a male connector including a male base and a plurality of male terminals received in the male base, a rear end of the male base defining a resilient arm protruded beyond the back of the male base, a substantial middle of a top of the resilient arm protruding upward to form a locking block, a guiding ramp being formed at a rear end of the locking block and slantwise connecting the back and a top face of the locking block; a female connector including a female base and a plurality of female terminals, a front face of the female base being concaved rearward to form a receiving chamber, the female terminals being disposed in the female base and further stretching forward in the receiving chamber, a top inner wall of the receiving chamber defining a guiding channel extending along a front-to-rear direction and penetrating through a front end and a rear end of the top inner wall, a locking portion protruding downward in the rear of the guiding channel with a guiding slope being formed at a front thereof in accordance with the guiding ramp of the male connector.

As described above, the cable connector of the present invention, when the male connector is engaged with the female connector, the male connector is inserted rearward in the receiving chamber of the female connector to make the male terminals and the female terminals electrically connect with each other, the locking block slides along the guiding channel until the locking block moves across the locking portion to be blocked behind the locking portion by virtue of the cooperation guidance of the guiding ramp and the guiding slope and the resilience of the resilient arm.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
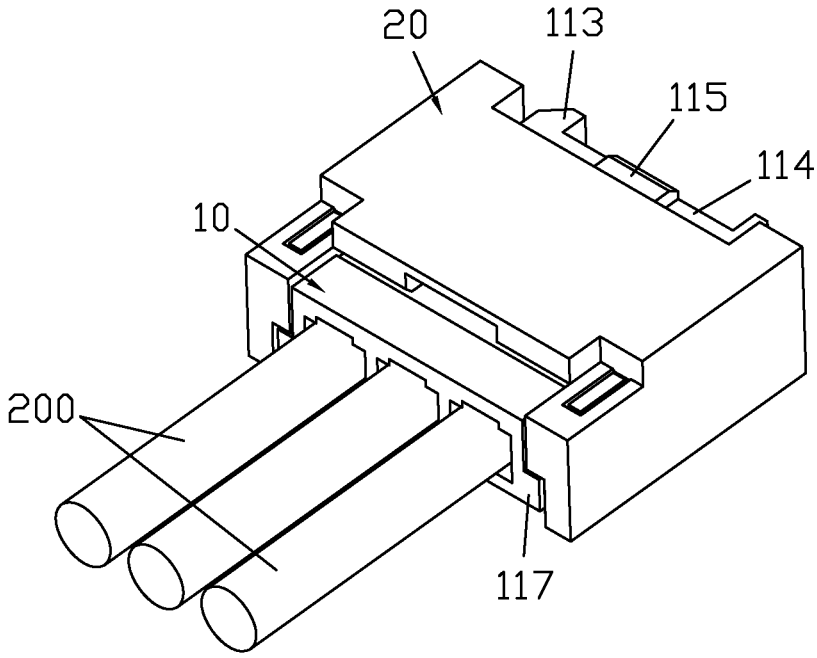
FIG. 1 is an assembled, perspective view of a cable connector and a cable in accordance with an embodiment of the present invention.
Figure 2:
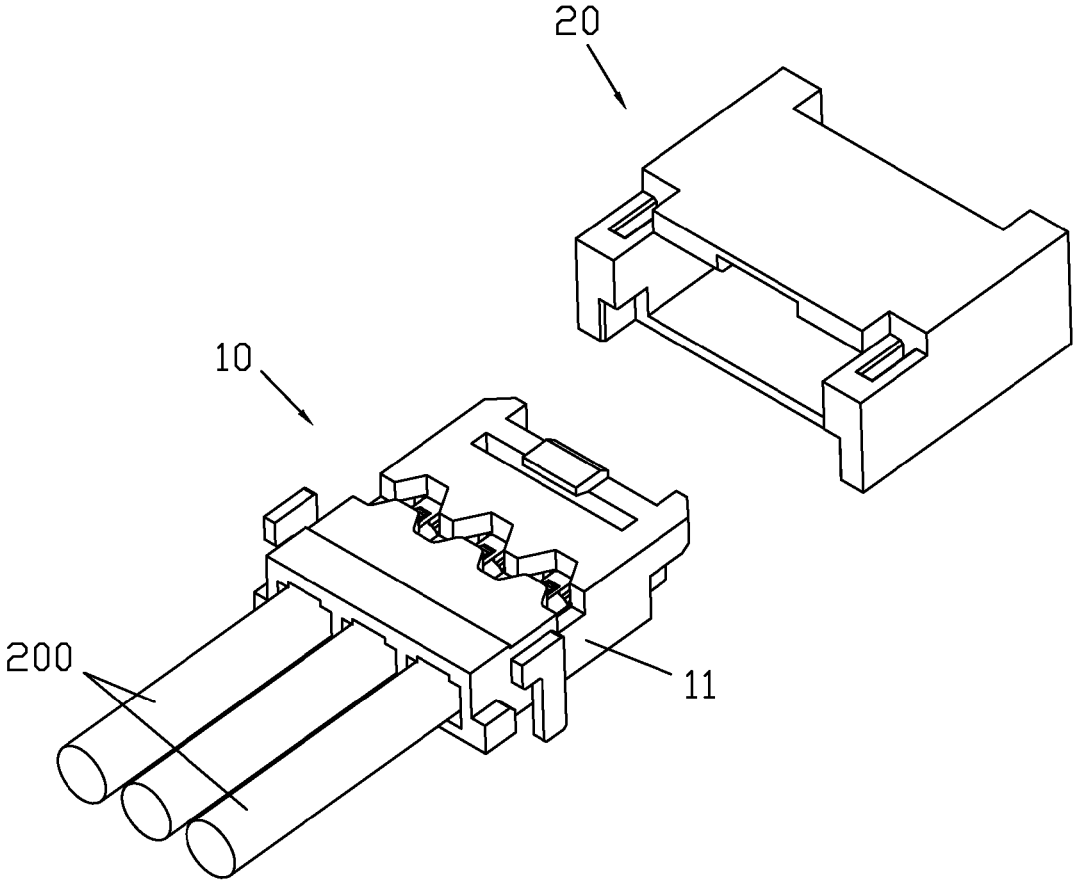
FIG. 2 is an exploded, perspective view of the cable connector and the cable shown in FIG. 1.
Figure 3:
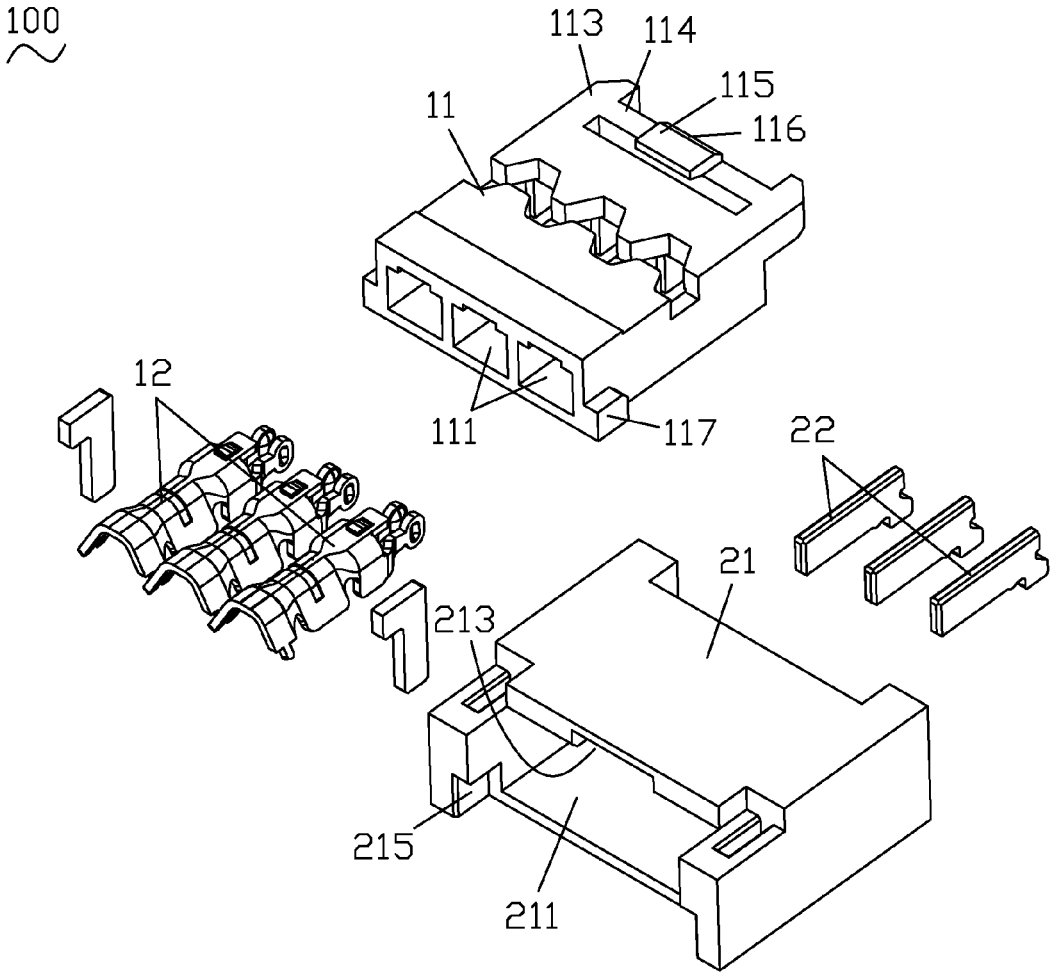
FIG. 3 is an exploded, perspective view of the cable connector shown in FIG. 1.
Figure 4:
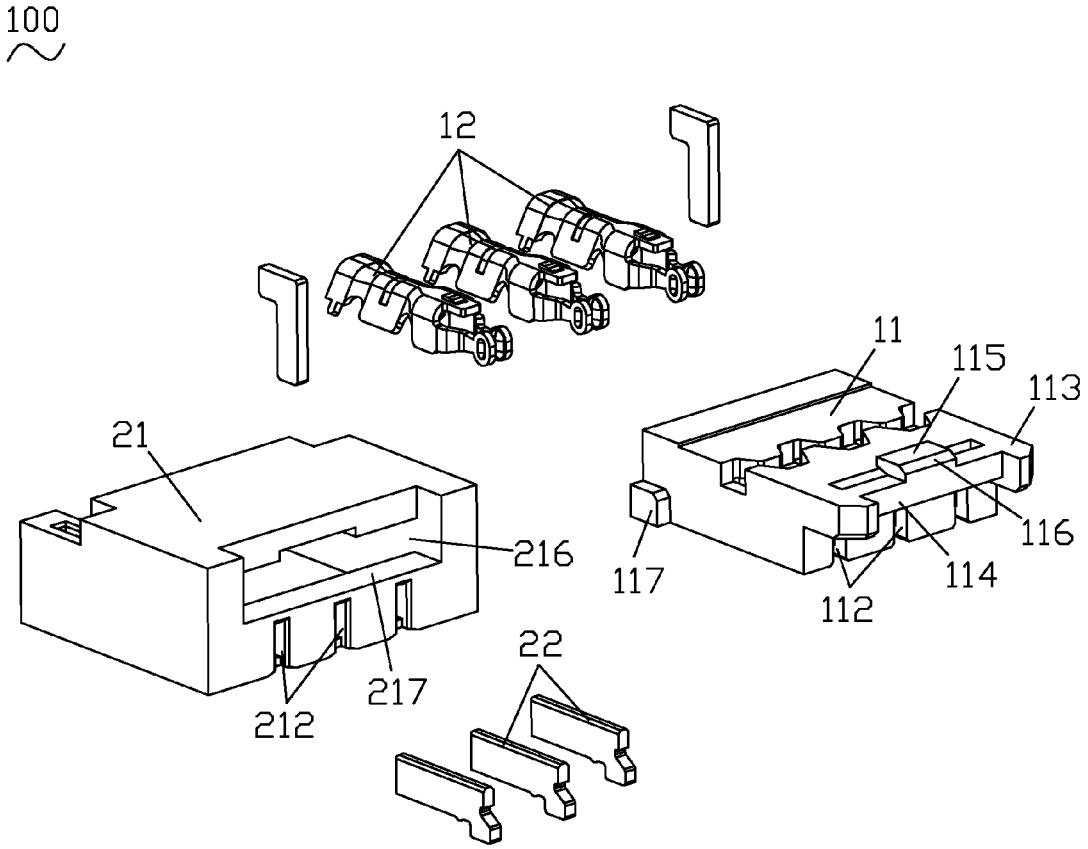
FIG. 4 is another perspective view of the cable connector shown in FIG. 1.
Figure 5:
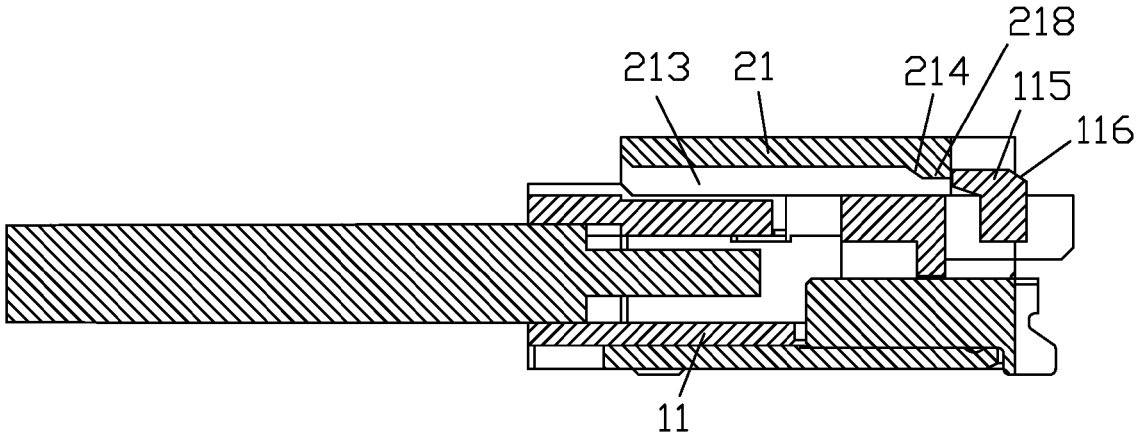
FIG. 5 is a side-sectional view of the cable connector shown in FIG. 1.

Referring to the drawings in greater detail, and first to FIG. 1 and FIG. 4, the embodiment of the invention is embodied in a cable connector 100. The cable connector 100 includes a male connector 10 and a female connector 20. The male connector 10 and female connector 20 are inserted into each other in order to achieve electrical connection, for the realization of the electrical connection of the cables 200 and associated equipment.

the male connector 10 includes a male base 11 and a plurality of male terminals 12 received in the male base 11, a rear end of the male base 11 defines a resilient arm 114 protruded beyond the back of the male base 11, a substantial middle of a top of the resilient arm 114 protrudes upward to form a locking block 115, a guiding ramp 116 is formed at a rear end of the locking block 115 and slantwise connecting the back and a top face of the locking block 115.

The female connector 20 includes a female base 21 and a plurality of female terminals 22, a front face of the female base 21 is concaved rearward to form a receiving chamber 211, the female terminals 22 are disposed in the female base 21 and further stretch forward in the receiving chamber, a top inner wall of the receiving chamber 211 defines a guiding channel extending along a front-to-rear direction and penetrating through a front end and a rear end of the top inner wall, a locking portion 213 protrudes downward in the rear of the guiding channel with a guiding slope 214 being formed at a front thereof in accordance with the guiding ramp 116 of the male connector 10.

wherein a front face of the male base 11 is concaved rearward to form a plurality of receiving passageways 111, the back of the male base 11 is concaved rearward to form a plurality of inserting slots 112 arranged in accordance with the receiving passageways 111 and further connected with the corresponding receiving passageways 111, a rear wall of the receiving chamber 211 of the female base 21 defines a plurality of fastening slots 212 penetrating there through along a front-to-rear direction and communicated with the receiving chamber 211, the male terminals 12 are received in the receiving passageways 111 of the male base 10, rears of the female terminals 21 are fastened in the fastening slots 212 and fronts of the female terminals 21 stretch forward in the receiving chamber 211 for being inserted through the inserting slots 112 to electrically connect with the corresponding male terminals 21 when the male connector 10 is engaged with the female connector 20.

Specifically, two opposite inner sidewalls of the receiving chamber 211 of the female connector 20 have front ends thereof opened with two positioning grooves 215, two opposite outer sides of the male base 11 have front ends thereof protrude sideward to form two positioning blocks positioned in the positioning grooves 215 respectively when the male connector 10 is engaged with the female connector 20.

Specifically, two sides of the rear end of the male base 11 extend rearward to form two connecting arms 113, the resilient arm 114 is connected between substantial middles of the connecting arms 113 and spaced from the back of the male base 11, an opening 216 is opened downward in the rear of the female base 21 and communicated with the receiving chamber 211 and the guiding channel, a supporting platform 217 is accordingly formed under the opening and behind the receiving chamber 211, when the male connector 10 is engaged with the female connector 20, the connecting arms 113 of the male base 11 pass through the receiving chamber 211 of the female base 21 to be received in the opening 216 and propped on the supporting platform 217.

with reference to FIG. 1 to FIG. 5, when the male connector 10 is engaged with the female connector 20, the male connector 10 is inserted rearward in the receiving chamber 211 of the female connector 20 to make the male terminals 12 and the female terminals 22 electrically connect with each other, the locking block 115 slides along the guiding channel until the locking block 115 moves across the locking portion 213 to be blocked behind the locking portion 213 by virtue of the cooperation guidance of the guiding ramp 116 and the guiding slope 214 and the resilience of the resilient arm 114.

As described above, the cable connector 100 of the present invention, when the male connector 10 is engaged with the female connector 20, the male connector 10 is inserted rearward in the receiving chamber of the female connector 20 to make the male terminals 12 and the female terminals 22 electrically connect with each other, the locking block slides along the guiding channel until the locking block moves across the locking portion to be blocked behind the locking portion by virtue of the cooperation guidance of the guiding ramp and the guiding slope and the resilience of the resilient arm. The designe is ensure that the male connector with the parent is not easy to quit after the engagement of the connector to avoid functional failure.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A cable connector, comprising:

a male connector including a male base and a plurality of male terminals received in the male base, a rear end of the male base defining a resilient arm protruded beyond the back of the male base, a substantial middle of a top of the resilient arm protruding upward to form a locking block, a guiding ramp being formed at a rear end of the locking block and slantwise connecting the back and a top face of the locking block; and a female connector including a female base and a plurality of female terminals, a front face of the female base being concaved rearward to form a receiving chamber, the female terminals being disposed in the female base and further stretching forward in the receiving chamber, a top inner wall of the receiving chamber defining a guiding channel extending along a front-to-rear direction and penetrating through a front end and a rear end of the top inner wall, a locking portion protruding downward in the rear of the guiding channel with a guiding slope being formed at a front thereof in accordance with the guiding ramp of the male connector, wherein when the male connector is engaged with the female connector, the male connector is inserted rearward in the receiving chamber of the female connector to make the male terminals and the female terminals electrically connect with each other, the locking block slides along the guiding channel until the locking block moves across the locking portion to be blocked behind the locking portion by virtue of the cooperation guidance of the guiding ramp and the guiding slope and the resilience of the resilient arm, wherein two sides of the rear end of the male base extend rearward to form two connecting arms, the resilient arm is connected between substantial middles of the connecting arms and spaced from the back of the male base, an opening is opened downward in the rear of the female base and communicated with the receiving chamber and the guiding channel, a supporting platform is accordingly formed under the opening and behind the receiving chamber, when the male connector is engaged with the female connector, the connecting arms of the male base pass through the receiving chamber of the female base to be received in the opening and propped on the supporting platform.

2. The cable connector as claimed in claim 1, wherein two opposite inner sidewalls of the receiving chamber of the female connector have front ends thereof opened with two positioning grooves, two opposite outer sides of the male base have front ends thereof protrude sideward to form two positioning blocks positioned in the positioning grooves respectively when the male connector is engaged with the female connector.

3. The cable connector as claimed in claim 1, wherein a front face of the male base is concaved rearward to form a plurality of receiving passageways, the back of the male base is concaved rearward to form a plurality of inserting slots arranged in accordance with the receiving passageways and further connected with the corresponding receiving passageways, a rear wall of the receiving chamber of the female base defines a plurality of fastening slots penetrating there through along a front-to-rear direction and communicated with the receiving chamber, the male terminals are received in the receiving passageways of the male base, rears of the female terminals are fastened in the fastening slots and fronts of the female terminals stretch forward in the receiving chamber for being inserted through the inserting slots to electrically connect with the corresponding male terminals when the male connector is engaged with the female connector.

* * * * *